US006890694B2

(12) United States Patent
Matsumura et al.

(10) Patent No.: US 6,890,694 B2
(45) Date of Patent: May 10, 2005

(54) TONER FOR DEVELOPING ELECTROSTATIC IMAGE, PROCESS FOR PRODUCING THE SAME, DEVELOPER FOR DEVELOPING ELECTROSTATIC IMAGE AND PROCESS FOR FORMING IMAGE

(75) Inventors: Yasuo Matsumura, Minamiashigara (JP); Hidekazu Yaguchi, Minamiashigara (JP); Satoshi Yoshida, Minamiashigara (JP); Takahisa Fujii, Minamiashigara (JP); Tomohito Nakajima, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 71 days.

(21) Appl. No.: 10/412,255

(22) Filed: Apr. 14, 2003

(65) Prior Publication Data

US 2003/0219665 A1 Nov. 27, 2003

(30) Foreign Application Priority Data

May 16, 2002 (JP) ..... 2002-142150

(51) Int. Cl.[7] ..... G03G 9/087

(52) U.S. Cl. ..... 430/108.1; 430/109.1; 430/124; 430/137.14; 430/111.4

(58) Field of Search ..... 430/108.1, 109.1, 430/111.4, 124, 137.14, 110.3, 108.2, 108.8, 108.4

(56) References Cited

U.S. PATENT DOCUMENTS

| | | | | |
|---|---|---|---|---|
| 4,855,207 A | * | 8/1989 | Tsubuko et al. | 430/108.4 |
| 5,346,797 A | | 9/1994 | Kmiecik-Lawrynowicz et al. | |
| 5,851,713 A | * | 12/1998 | Hayashi et al. | 430/109.3 |
| 6,416,918 B2 | * | 7/2002 | Matsumura et al. | 430/110.4 |

FOREIGN PATENT DOCUMENTS

| | | |
|---|---|---|
| JP | A 63-282752 | 11/1988 |
| JP | A 6-250439 | 9/1994 |

* cited by examiner

*Primary Examiner*—John L Goodrow
(74) *Attorney, Agent, or Firm*—Oliff & Berridge, PLC

(57) ABSTRACT

A toner for developing an electrostatic image and a process for producing the same, a developer for developing an electrostatic image, and a process for producing an image are provided. The toner contains a colorant and a binder resin, and also contains a polyolefin resin containing a polar group and having a glass transition point of 20° C. or less and a weight average molecular weight of 10,000 or more.

16 Claims, No Drawings

TONER FOR DEVELOPING ELECTROSTATIC IMAGE, PROCESS FOR PRODUCING THE SAME, DEVELOPER FOR DEVELOPING ELECTROSTATIC IMAGE AND PROCESS FOR FORMING IMAGE

BACKGROUND OF THE INVENTION

1. Field of the Invention

The present invention relates to a toner for developing an electrostatic image used upon developing an electrostatic latent image formed by an electrophotographic process or an electrostatic recording process with a developer, and a process for producing the same.

2. Description of the Related Art

A method for visualizing image information through an electrostatic image by an electrophotographic process has been utilized in various fields of art. In the electrophotographic process, an electrostatic image is formed on a photoreceptor through charging and exposing steps, and the electrostatic latent image is developed with a developer containing a toner and then visualized through transferring and fixing steps. The developer used herein is classified into a two-component developer containing a toner and a carrier and a one-component developer using a magnetic toner or a non-magnetic toner solely. The toner is generally produced by a kneading and pulverizing method, in which a thermoplastic resin is melted and mixed with a pigment, a charge controlling agent and a releasing agent, such as wax, and after cooling, the mixture is finely pulverized and then classified. Inorganic or organic fine particles may be added to the surface of the toner particles depending on necessity in order to improve the flowability and the cleaning property thereof.

In recent years, duplicators, printers and complex machines of them with a facsimile machine by means of color electrophotographic process are significantly spread. In order to obtain moderate glossiness for reproducing a color image and to realize transparency for obtaining an excellent OHP image, it is generally difficult to use a releasing agent, such as wax. Accordingly, a large amount of an oil is applied to a fixing roll to assist releasing, which causes stickiness of a duplicated image including an OHP image and difficulty in writing on the image with a pen, and also heterogeneous glossiness often occurs.

In the ordinary monochrome (black and white) duplication, furthermore, wax, such as polyethylene, polypropylene and paraffin, which is generally used in a monochrome toner, is difficult to use because the OHP transparency is liable to be deteriorated.

Even though the transparency is sacrificed, it is difficult to suppress exposure of wax on the surface by the production process of the toner using the conventional kneading and pulverizing method. Therefore, such problems are caused upon using as a developer, as considerable deterioration in flowability and filming on a developing device and a photoreceptor. Hardware designs are in progress especially for color and/or toner reclaiming process.

Intermediate transfer system and/or toner reclaiming process of remaining toner on photoreceptor require more reliability of toner and developer materials.

As an ultimate method for removing the problems, such a production process by a polymerization method is proposed that an oily phase containing a monomer as a raw material of a resin and a colorant is dispersed in an aqueous phase and then is directly polymerized to form a toner, whereby the wax is encompassed in the interior of the toner to suppress exposure thereof on the surface.

Furthermore, as a method for intentionally controlling the shape of the toner and the surface structure thereof, production processes of a toner by an emulsion polymerization and aggregation method are proposed in JP-A-63-282752 and JP-A-6-250439. In these production processes, generally, a resin dispersion is produced by emulsion polymerization, and separately, a colorant dispersion is produced by dispersing a colorant in a solvent. The dispersions are mixed to form aggregates having a diameter corresponding to the particle diameter of the toner, which are fused and coalesced by heating to form the toner.

These production processes not only realize internal inclusion of wax, but also facilitate to form toners having small diameters and enable reproduction of an image with high resolution and high sharpness.

In the case where these production processes are employed, designing of characteristics of the resin is significantly important for realizing high image quality. In order to obtain a broad color reproduction band, not only optimization of a colorant but also formation of an image with glossiness of a certain level or higher through the melting characteristics of the resin are required. On this account, the resin is designed in such a manner that the elasticity thereof is decreased to lower the melt viscosity upon heating with a heating roll, so as to facilitate flow thereof. In order to realize such a nature, the molecular weight of the resin is necessarily decreased. However, in the case where the elasticity is decreased, the adhesiveness to the heat roll is increased, and it is difficult to release from the roll without the presence of a fixing oil even when a releasing agent, such as wax, is contained. Furthermore, hot offset at a high temperature is liable to cause a problem due to the low molecular weight, and as a result, the resulting toner is liable to have a significantly narrow usable temperature range.

Moreover, in the case where the molecular weight is decreased, the glossiness is increased to improve the image quality, but the fixed image is liable to become mechanically brittle. Therefore, image defects are liable to be formed due to folding of a medium, such as paper, and thus a problem occurs on the standpoint of durability of images.

As described in the foregoing, in order to provide a high quality image through the electrophotographic process and to maintain the stable performance of the toner under various kinds of mechanical stress, it is necessary that the species and the amounts of the pigment and the releasing agent are optimized, and the releasing agent is suppressed from exposing on the surface, and it is also important that the glossiness and the releasing property without the presence of a fixing oil are improved through optimization of the characteristics of the resin, and hot offset is suppressed.

SUMMARY OF THE INVENTION

The invention is developed to solve the problems associated with the conventional toners and to provide a toner for developing an electrostatic image having the following characteristics and a process for producing the same.

The invention is to provide:

1. a toner having good durability and providing a fixed image having a high mechanical strength;

2. a toner having good releasing performance and having both glossiness and transparency;

3. a color developer having a broad color reproduction band capable of forming a color image with high quality and high durability;

4. a toner having a broad fixable temperature range to provide better usability; and 5. a developer having good charge maintaining property and high reliability upon use with a long service lifein the machine with intermediate transfer system and/or toner reclaiming process.

The toner for developing an electrostatic image according to the invention contains a colorant and a binder resin, the toner containing a polyolefin resin having a polar group and having a glass transition point of 20° C. or less and a weight average molecular weight of 10,000 or more.

The process for producing a toner for developing an electrostatic image according to the invention contains the steps of: aggregating particles in a dispersion containing the particles dispersed therein, the particles containing resin particles containing a polyolefin resin having a polar group and having a glass transition point of 20° C. or less and a weight average molecular weight of 10,000 or more; and coalescing the aggregated particles by heating.

The developer for developing an electrostatic image according to the invention contains a toner and a carrier, the toner containing the toner for developing an electrostatic image according to the invention.

The process for producing an image according to the invention contains the steps of: forming an electrostatic latent image on an electrostatic latent image holding member; developing the electrostatic latent image with a developer; transferring a toner image thus formed to a transfer body; and fixing the toner image on the transfer body, the toner for forming the toner image containing a polyolefin resin having a polar group and having a glass transition point of 20° C. or less and a weight average molecular weight of 10,000 or more, a colorant, and a binder resin.

DESCRIPTION OF THE PREFERRED EMBODIMENTS

The invention will be described in detail with reference to the preferred embodiments below.

[Toner for Developing Electrostatic Image]

(Polyolefin Resin Having Polar Group)

Examples of the polar group in the polyolefin resin contained in the binder resin of the embodiment include an acidic group, such as a carboxyl group, a sulfone group, a sulfonyl group and a hydroxyl group, and an basic group, such as a nitrile group, an amide group, an amino group and an ammonium group, and the acidic group is preferred.

The polyolefin resin used in the embodiment preferably has a glass transition temperature of 20° C. or less.

The polyolefin resin used in the embodiment preferably has a weight average molecular weight (Mw) of from 10,000 to 3,000,000. When the Mw of the polyolefin resin is less than 10,000, the effect on the mechanical strength is liable to be decreased, and when the Mw exceeds 3,000,000, such problems are caused that the toner is difficult to be produced, and the fixing temperature becomes too high. The weight average molecular weight herein is measured with gel permeation chromatography (GPC) in terms of a value of the THF soluble component with polystyrene conversion.

The polyolefin resin is preferably such a polyolefin resin having a copolymerization ratio of a monomer having a polar group and an olefin monomer of from 5/95 to 50/50, having a glass transition point of 20° C. or less, and having a polar group on a main chain thereof. In the case where the copolymerization ratio is less than 5/95, a problem of lowering the mechanical strength is caused, and when the copolymerization ratio exceeds 50/50, such problems are caused that stickiness and deterioration in mechanical strength occurs in the fixed image.

Examples of the polyolefin resin having a polar group include copolymers of various combinations of monomers including resins obtained by subjecting polyethylene, polypropylene, polybutadiene, polyisoprene and the like to an oxidation treatment; resins obtained by copolymerizing a monomer, such as ethylene, propylene, butene, butadiene, isoprene, chloroprene, vinyl chloride and vinylidene chloride, with an acid monomer, such as an acrylate, vinyl acetate, acrylic acid, methacrylic acid, maleic acid, monobutyl maleate, monooctyl maleate, itaconic acid, cinnamic acid, sulfonated styrene and an alkali metal salt, e.g., an Na salt, and an alkaline earth metal salt thereof, allylsulfosuccinic acid, and octyl allylsulfosuccinate and an alkali metal salt, e.g., an Na salt, and an alkaline earth metal salt thereof, and a base monomer, such as an acrylate ester monomer having an amine group, e.g., dimethylaminoethyl acrylate, diethylaminoethyl methacrylate, diethylaminoethyl acrylate and quaternary ammonium salts thereof, an N-substituted acrylic acid amide monomer, e.g., acrylamide, methacrylamide and N,N-dimethylacrylamide, vinylpyridine, vinylpyrrolidone and diallyalkylamine monomer; resins obtained by copolymerizing acrylonitrile with these monomer, e.g., ethylene, propylene, butene, butadiene, isoprene, chloroprene, vinyl chloride and vinylidene chloride; and resins obtained by further copolymerizing styrene with these monomer sets.

Among these, an ethylene-vinyl acetate copolymer and an ethylene-acrylic acid copolymer provide high performance, and the properties of the polymers can be relatively easily controlled.

It is also effective that the polar group of the polyolefin resin is subjected to a reaction with a metallic ion, such as Na, Ca, Zn and Mg, to improve the strength.

The polyolefin resin has both elasticity and durability, and it is considered that owing to the polar group on the main chain, the polyolefin resin is firmly bonded to a styrene resin and a polyester resin as the matrix resin upon fixing to form a backbone, thereby improving the durability of the image.

In general, glossiness of an image can be easily increased in heat fixing using a heat fixing roll by lowering the molecular weight of the binder resin to lower the viscosity upon heat melting and to improve the flowability. In this case, however, problems occur in durability, for example, upon folding the medium due to decrease of the mechanical strength of the fixed image, in addition to the problems of the hot offset and the releasing property on fixing described in the foregoing. As a result of investigations to realize glossiness and durability, it has been found that the polyolefin resin having a glass transition point of 20° C. or less and having a polar group on a main chain thereof exerts high performance described later.

The polyolefin resin having a glass transition point of 20° C. or less and having a polar group on a main chain thereof relaxes the brittleness of the ordinary resin for toners, such as a styrene resin and a polyester resin having a low molecular weight as a main binder resin in the fixed image, and it particularly exerts large effects upon improving the mechanical durability upon folding. The adhesiveness to a transfer member is improved owing to the polar group.

The content of the polyolefin resin having a polar group is preferably from 0.5 to 30%, and more preferably from 1 to 20%, based on the entire toner.

The glass transition point (Tg) of the polyolefin resin having a polar group is necessarily lower than the Tg of the main binder resin, and in particular, the improvement of the folding strength becomes insufficient unless it is 20° C. or less. The Tg is more preferably 5° C. or less.

The toner preferably has a volume particle size distribution index GSDv of 1.30 or less, and preferably 1.25 or less, which is important to obtain an image having high sharpness, and it is more preferably 1.23 or less. When the GSDv exceeds 1.30, it causes deterioration in resolution and image defects, such as scattering of the toner and fogging.

The toner of the invention preferably has a shape factor (SF1) of 140 or less, and more preferably from 115 to 135, whereby a toner for developing an electrostatic image excellent in charging characteristics, cleaning property and transfer property can be provided. When the shape factor exceeds 140, the transfer efficiency from the electrostatic image holding member carrying the toner image to the transfer body is lowered to impair the reliability in image quality. In this case, uniformity of a solid image and reproducibility of a thin line are also liable to be impaired.

The cleaning property referred herein is those through blade cleaning, which is most frequently employed.

The toner of the invention preferably has a surface property index, which is defined by the following equation, of 2.0 or less in the emulsion polymerization and aggregation process described in the foregoing, whereby it exerts good transfer property, and high image quality is uniformly realized by high transfer efficiency particularly to paper and a transfer medium having high surface roughness.

$$\text{(surface property index)}=\text{(measured value of specific surface area)}/\text{(calculated value of specific surface area)}$$

$$\text{(calculated value of specific surface area)}=6\Sigma(n\times R^2)/(\rho\times\Sigma(n\times R^3))$$

wherein n represents the number of particles in a channel of a Coulter counter, R represents the channel particle diameter of the Coulter counter, and ρ represents the density of the toner. The number of channels is 16, and the size of division is 0.1 interval in log scale.

(Colorant)

In the invention, the following colorants, for example, can be used.

Examples of a black pigment include carbon black, copper oxide, manganese dioxide, aniline black, activated carbon, non-magnetic ferrite and magnetite.

Examples of a yellow pigment include chrome yellow, zinc yellow, yellow iron oxide, cadmium yellow, chrome yellow, Hansa Yellow, Hansa Yellow 10G, Benzidine Yellow G, Benzidine Yellow GR, Suren Yellow, Quinoline Yellow and Permanent Yellow NCG.

Examples of an orange pigment include red chrome yellow, molybdenum orange, Permanent Orange GTR, Pyrazolone Orange, Vulkan Orange, Benzidine Orange G, Indanethrene Brilliant Orange RK and Indanethrene Brilliant Orange GK.

Examples of a red pigment include red iron oxide, cadmium red, red lead oxide, mercury sulfide, Watchyoung Red, Permanent Red 4R, Lithol Red, Naphthol Red, Brilliant Carmine 3B, Brilliant Carmine 6B, Du Pont Oil Red, Pyrazolone Red, Rhodamine B Lake, Lake Red C, Rose Bengal, Eoxine Red and Alizarin Lake.

Examples of a blue pigment include Prussian Blue, cobalt blue, Alkali Blue Lake, Victoria Blue Lake, Fast Sky Blue, Indanethrene Blue BC, Aniline Blue, Ultramarine Blue, Calco Oil Blue, Methylene Blue Chloride, Phthalocyanine Blue, Phthalocyanine Green and Malachite Green Oxalate.

Examples of a violet pigment include manganese violet, Fast Violet B and Methyl Violet Lake.

Examples of a green pigment include chromium oxide, chromium green, Pigment Green, Malachite Green Lake and Final Yellow Green G.

Examples of a white pigment include zinc white, titanium oxide, antimony white and zinc sulfide.

Examples of a body pigment include barite powder, barium carbonate, clay, silica, white carbon, talc and white alumina.

Examples of a dye include various kinds of dyes, such as basic, acidic, dispersion and direct dyes, e.g., nigrosine, Methylene Blue, Rose Bengal, Quinoline Yellow and Ultramarine Blue.

These colorants are used solely or as a mixture. A dispersion of colorant particles can be prepared by using, for example, a rotation shearing homogenizer, a media dispersing apparatus, such as a ball mill, a sand mill and an attritor, and a high pressure counter collision dispersing apparatus. The colorant can be dispersed in an aqueous system with a homogenizer by using a surfactant having polarity.

The colorant used in the invention is selected from the standpoint of hue angle, chroma saturation, brightness, weather resistance, OHP transparency and dispersibility in the toner.

The colorant can be added in an amount of from 2 to 15% by weight based on the weight of the total solid content of the toner.

In the case where a magnetic material is used as a black colorant, it can be added in an amount of from 10 to 70% by weight, which is different from the other colorants.

The mixing amount of the colorant is such an amount that is necessary for assuring coloration property upon fixing. In the case where the colorant particles in the toner have a median diameter of from 100 to 330 nm, the OHP transparency and the coloration property can be assured.

The median diameter of the colorant particles can be measured, for example, by a laser diffraction particle size measuring apparatus (LA-700, produced by Horiba, Ltd.).

In the case where the toner is used as a magnetic toner, magnetic powder may be contained therein. Specifically, a substance that can be magnetized in a magnetic field is used, examples of which include ferromagnetic powder, such as iron, cobalt and nickel, and compounds, such as ferrite and magnetite.

In the case where the toner is obtained in an aqueous system in the invention, it is necessary to attend to aqueous phase migration property of the magnetic material, and it is preferred that the surface of the magnetic material is modified in advance, for example, subjected to a hydrophobic treatment.

(Binder Resin)

Examples of the binder resin include a homopolymer and a copolymer of a vinyl monomer, for example, a styrene compound, such as styrene and p-chlorostyrene, a vinyl ester compound, such as vinylnaphthalene, vinyl chloride, vinyl bromide, vinyl fluoride, vinyl acetate, vinyl propionate, vinyl benzoate and vinyl butyrate, a methylene aliphatic carboxylate compound, such as methyl acrylate, ethyl acrylate, n-butyl acrylate, isobutyl acrylate, dodecyl acrylate, n-octyl acrylate, 2-chloroethyl acrylate, phenyl acrylate, methyl (α-chloroactylate, methyl methacrylate, ethyl methacrylate and butyl methacrylate, acrylonitrile, methacrylonitrile, acrylamide, a vinyl ether compound, such as vinyl methyl ether, vinyl ethyl ether and vinyl isobutyl ether, a monomer having an N-polar group, such as an N-vinyl compound, e.g., N-vinylpyrrole, N-vinylcarbazole, N-vinylindole and N-vinylpyrrolidone, and a vinyl carboxylic acid, such as methacrylic acid, acrylic acid, cinnamic acid and carboxyethyl acrylate, and/or various kinds of polyester compounds, and various kinds of wax may also be used in combination.

In the case of a vinyl monomer, emulsion polymerization can be carried out by using an ionic surfactant to form a resin fine particle dispersion. In the case of the other resins that can be dissolved in an oily solvent having a relatively low solubility in water, the resin is dissolved in the solvent and dispersed in water to a fine particle form by using a dispersing apparatus, such as a homogenizer, along with an ionic surfactant or a polymer electrolyte, and then the solvent is evaporated by heating or depressurizing to form a resin fine particle dispersion.

The median diameter of the fine particles in the resulting resin fine particle dispersion used in the invention is suitably 1 $\mu$m or less, preferably from 50 to 400 nm, and more preferably from 70 to 350 $\mu$m.

The median diameter of the resin fine particles can be measured, for example, by a laser diffraction particle size measuring apparatus (LA-700, produced by Horiba, Ltd.).

(Internal Additive)

As an internal additive, a magnetic material containing a metal and an alloy, such as ferrite, magnetite, reduced iron, cobalt, nickel and manganese, and compounds containing these metals can be used, and as a charge controlling agent, various kinds of charge controlling agents that are ordinarily employed, such as a quaternary ammonium salt compound, a nigrosine compound, a dye containing a complex of aluminum, iron or chromium, and a triphenylmethane pigment, can be used. Those materials that are difficult to be dissolved in water are preferred therefor from the standpoint of control of the ion strength influencing the stability upon aggregation and coalescence, and reduction of pollution due to wastewater.

(Releasing Agent)

Specific examples of the releasing agent used in the invention include a low molecular weight polyolefin, such as polyethylene, polypropylene and polybutene, a silicone exhibiting a softening point upon heating, an aliphatic amide, such as oleic acid amide, erucic acid amide, recinoleic acid amide and stearic acid amide, vegetable wax, such as carnauba wax, rice wax, candelilla wax, wood wax and jojoba oil, animal wax, such as bees wax, mineral or petroleum wax, such as montan wax, ozokerite, ceresin, paraffin wax, microcrystalline wax and Fischer-Tropsch wax, and modified products thereof.

These kinds of wax are substantially not dissolved in a solvent at around the room temperature, such as toluene, or even they are dissolved, the dissolved amount is quite small.

The wax is dispersed in water along with an ionic surfactant or a polymer electrolyte, such as a polymer acid and a polymer base, and it is heated to a temperature higher than the melting point thereof and is simultaneously dispersed with a homogenizer or a pressure discharge disperser (Gaulin Homogenizer) capable of applying a large shearing force, so as to form a dispersion of particles having a median diameter of 1 $\mu$m or less.

The releasing agent is preferably added in an amount of from 5 to 25% by weight based on the total weight of the solid content constituting the toner in order to assure releasing property of a fixed image in an oilless fixing system.

The particle diameter of the resulting releasing agent particle dispersion can be measured, for example, by a laser diffraction particle size measuring apparatus (LA-700, produced by Horiba, Ltd.). Upon using the releasing agent, it is preferred that the resin fine particles, the colorant fine particles and the releasing agent particles are aggregated, and then the resin fine particle dispersion is further added to attach the resin fine particles on the surface of the aggregated particles from the standpoint of assurance of charging property and durability.

(Developer)

A developer of the embodiment is a developer containing the toner for developing an electrostatic image described in the foregoing and a carrier.

Therefore, the toner and the developer for developing an electrostatic image of the invention have good charging characteristics, excellent environmental dependency resistance and excellent cleaning property, and a toner having a small particle diameter with a sharp particle size distribution can be conveniently obtained by the production process of the invention, whereby a full color image with high image quality can be produced.

[Production Process of Toner for developing Electrostatic Image]

In the production process of a toner for developing an electrostatic image containing the steps of aggregating particles in a dispersion containing the particles dispersed therein, the particles containing resin particles containing a polyolefin resin having a polar group thereof and having a glass transition point of 20° C. or less and a weight average molecular weight of 10,000 or more, and coalescing the aggregated particles by heating to fuse (i.e., the emulsion polymerization and aggregation method), the resin is previously subjected to a method for obtaining a dispersion of resin particles by such a method that the dispersion of resin particles is directly obtained by emulsion polymerization or soap-free polymerization, or such a method that the resin obtained by bulk polymerization or suspension polymerization is heated in water and formed into fine particles by applying shearing force with a homogenizer.

At this time, a stable fine resin particle dispersion can be obtained in a more convenient manner by using a dispersant, such as a surfactant. To obtain aggregated particles of fine particles in water, inorganic metallic salts and/or surfactants are effectively used.

An inorganic metallic salt used in the emulsion polymerization and aggregation method of the invention can be obtained by dissolving an ordinary inorganic metallic compound or a polymer thereof in the resin fine particle dispersion. The metallic element constituting the inorganic metallic salt may be those having divalent electric charge and belonging to the 2A, 3A, 4A, 5A, 6A, 7A, 8, 1B, 2B and 3B Groups in the periodic table (long form periodic table) and being dissolved in the aggregation system of the resin fine particles in the form of an ion. Specific and preferred examples of the inorganic metallic salt include a metallic salt, such as calcium chloride, calcium nitrate, barium chloride, magnesium chloride, zinc chloride, aluminum chloride and aluminum sulfate, and an inorganic metallic salt polymer, such as polyaluminum chloride, polyaluminum hydroxide and polycalcium sulfate. Among these, aluminum salts and a polymer thereof are particularly preferred. In order to obtain a sharp particle size distribution, it is generally preferred to use a divalent inorganic metallic salt rather than a monovalent one, to use a trivalent one rather than a divalent one, and to use a inorganic metallic salt polymer rather than a monomeric one assuming that the valence numbers are the same.

The use of the inorganic metallic salt is effective for the conventional toner produced by the kneading and pulverizing method, but is particularly effective for the toner produced by the emulsion polymerization and aggregation method, which is free of the brittleness requirement for pulverization and can be highly controllable in structure, in comparison to the conventional toner produced through pulverization, which is required to have brittleness of the resin for pulverization, and cannot be suppressed from exposure of a low glass transition point resin on the surface of the toner.

The exposure of a low glass transition point resin on the surface of the toner lowers the flowability of the toner, and thus blocking upon using at a high temperature is difficult to be suppressed.

In the toner produced by the emulsion polymerization and aggregation method, the primary aggregated particles are covered with resin particles having a high glass transition point before coalescence by heating to form a capsule structure, whereby good flowability is maintained in the using condition before fixing, so as to maintain reliability in a toner cartridge and hardware.

In the case where a toner is produced by the emulsion polymerization and aggregation method, in order to obtain a toner having a narrower particle size distribution, it is important that the polyolefin resin is dispersed to have a median particle diameter of 1 μm or less, and more preferably, it is important that it is dispersed to have a median particle diameter of 0.5 μm or less, and no component having a diameter of 1 μm or more is contained in the bottom of the distribution on the large particle diameter side.

Examples of the surfactant used in emulsion polymerization, seed polymerization, dispersion of a pigment, resin particles, dispersion of a releasing agent, aggregation and stabilization of these operations include an anionic surfactant, such as a sulfate ester salt series, a sulfonate salt series, a phosphate ester series and a soap series, and a cationic surfactant, such as an amine salt series and a quaternary ammonium salt series, and it is effective that a nonionic surfactant, such as a polyethylene glycol series, an alkylphenol ethylene oxide adduct series and a polyvalent alcohol series, is effectively used in combination. Examples of the method for dispersion include an ordinary apparatus including a rotation shearing homogenizer and a media dispersing apparatus, such as a ball mill, a sand mill and a dynomill.

After the toner of the invention is dried in the similar manner as the ordinary toners, inorganic fine particles, such as silica, alumina, titania and calcium carbonate, or resin fine particles, such as a vinyl resin, polyester and silicone, may be added to the surface of the toner particles under application of a shearing force in a dry state, so as to impart flowability and to improve the cleaning property.

In the case where the fine particles are attached to the surface of the toner in water, as examples of the inorganic fine particles, any material that is generally used as an external additive to the surface of the toner, such as silica, alumina, titania, calcium carbonate, magnesium carbonate and tricalcium phosphate, may be used after dispersing with an ionic surfactant, a polymer acid or a polymer base.

After completing the fusing and coalescing step of the aggregated particles, a washing step, a solid-liquid separating step and a drying step are arbitrarily carried out to obtain desired toner particles. Under consideration of charging property, the washing step is preferably carried out by sufficient substitution washing with ion exchanged water. The solid-liquid separating step is not particularly limited, and suction filtration and pressurization filtration are preferred from the standpoint of productivity. The drying step is also not particularly limited, and freeze drying, flash jet drying, fluidized drying and vibrating fluidized drying are preferably employed from the standpoint of productivity.

The weight average molecular weight of the toner of the invention thus obtained is suitably from 15,000 to 55,000, and preferably from 20,000 to 48,000. When the weight average molecular weight is less than 15,000, the aggregation force of the binder resin is liable to be lowered, and there are some cases where the oilless releasing property is deteriorated. When it exceeds 55,000, the smoothness upon fixing becomes poor, and there are cases where the glossiness is decreased, while the oilless releasing property is good.

The glass transition point Tg of the toner of the invention is suitably from 45 to 65° C., and preferably from 48 to 60° C. When the Tg is less than 45° C., the aggregation force of the binder resin itself in a high temperature range is lowered, and thus hot offset is liable to occur upon fixing. When it exceeds 65° C., there are some cases where sufficient melting cannot be obtained to lower the glossiness of the fixing sheet.

The volume average particle size $D_{50}$ of the toner of the invention is suitably in a range of from 3.0 to 9.0 μm, and preferably from 3.0 to 8.0 μm. When the $D_{50}$ is less than 3.0 μm, the charging property becomes insufficient, and there are some cases where the developing property is lowered. When it exceeds 9.0 μm, the resolution of the image is lowered.

The volume average particle size $D_{50}$ and the average particle size distribution index in the invention can be obtained in the following manner. Based on the particle size distribution measured by a measuring apparatus, such as Coulter Counter TAII (produced by Nikkaki Co., Ltd.) and Multisizer II (produced by Nikkaki Co., Ltd.), cumulative distributions of the volume and the number are drawn from the small sizes side with respect to the divided particle size ranges (channels). The particle sizes at a cumulative amount of 16% are designated as $D_{16V}$ for volume and $D_{16P}$ for number, the particle sizes at a cumulative amount of 50% are designated as $D_{50V}$ for volume and $D_{50P}$ for number, and the particle sizes at a cumulative amount of 84% are designated as $D_{84V}$ for volume and $D_{84P}$ for number. By using these values, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

The shape factor SF1 of toner particles of the toner of the invention is suitably from 100 to 140, and preferably from 110 to 135, from the standpoint of image forming property. The shape factor SF1 in the invention can be obtained in the following manner. An optical micrograph of the toner scattered on slide glass is imported into a Luzex image analyzer through a video camera, and 50 or more toner particles are measured for the peripheral length (ML) and the projected area (A). The shape factor SF1 of the toner is designated as a value obtained by dividing square of the peripheral length by the projected area (i.e., $SF1=ML^2/A\times\pi/4\times100$).

EXAMPLES

The invention will be further described in more detail with reference to the following examples, but the invention is not limited thereto.

The toners are produced in the following manner. The resin fine particle dispersions, the colorant particle dispersions and the releasing agent particle dispersion described below are respectively prepared, and these are mixed in the prescribed proportions. Under stirring the mixture, a metallic salt aggregating agent is added thereto, and it is ionically neutralized to form aggregated particles. Subsequently, an inorganic hydroxide is added thereto to adjust the pH in the system to a weakly acidic condition to a neutral condition, the mixture is then heated to a temperature higher than the glass transition point of the resin fine particles to effect fusion and coalescence. After completing the reaction, sufficient washing, solid-liquid separation and drying steps are carried out to obtain the desired toner.

The preparation methods will be described.

(Preparation of Polyolefin Resin Fine Particle dispersion Having Polar Group (Polyolefin Resin Dispersion A))

Ethylene-vinyl acetate resin Dispersion

| | |
|---|---|
| Polyvinyl alcohol (Denka Poval B17) | 4.7 parts by weight |
| Sodium acetate | 0.9 part by weight |
| Ion exchanged water | 408 parts by weight |
| Sodium aldehyde sulfoxylate | 0.54 part by weight |
| EDTA | 0.04 part by weight |
| Ferrous sulfate | 0.02 part by weight |
| Vinyl acetate | 282 parts by weight |

The foregoing components are charged in a pressure reaction vessel, and after substitution with nitrogen under stirring, 87 parts by weight of ethylene is charged with increase of the temperature. After completing the addition of ethylene, when the liquid temperature reaches 55° C., an aqueous solution having 3 parts by weight of ammonium persulfate dissolved therein is continuously added. After completing the addition, 153 parts by weight of vinyl acetate is continuously added to obtain an ethylene-vinyl acetate resin emulsion A having a glass transition point of 0° C., a median diameter of 0.45 μm and a solid content of 56.0%.

(Preparation of Polyolefin Resin fine Particle Dispersion Having Polar Group (Polyolefin Resin Dispersion B))

Ethylene-acrylic acid resin Dispersion

| | |
|---|---|
| Ethylene-acrylic acid resin (melting point: 92° C.) (HYTEC, produced by Toho Chemical Industry Co., Ltd.) | 50 parts by weight |
| Anionic surfactant (Dowfax, produced by Rhodia, Inc.) | 5 parts by weight |
| Ion exchanged water | 200 parts by weight |

The foregoing components are heated to 120° C. and sufficiently dispersed in a homogenizer (Ultra Turrax T50, produced by IKA Works Inc.), and then they are subjected to a dispersion treatment with a pressure discharge disperser (Gaulin Homogenizer) to obtain an ethylene-acrylic acid resin particle dispersion B having a glass transition point of 0° C. or less, a median diameter of 250 nm and a solid content of 22.0%.

(Preparation of Polyolefin Resin Fine Particle Dispersion Having No Polar Group (Polyolefin Resin Dispersion C))

| | |
|---|---|
| Polyethylene dispersion Polyethylene (melting point: 120° C.) (PE190, produced by Clariant Inc.) | 50 parts by weight |
| Anionic surfactant (Dowfax, produced by Rhodia, Inc.) | 5 parts by weight |
| Ion exchanged water | 200 parts by weight |

The foregoing components are heated to 130° C. and sufficiently dispersed in a homogenizer (Ultra Turrax T50, produced by IKA Works Inc.), and then they are subjected to a dispersion treatment with a pressure discharge disperser (Gaulin Homogenizer) to obtain a polyethylene resin particle dispersion C having a glass transition point of 0° C. or less, a median diameter of 250 nm and a solid content of 22.0%.

(Preparation of Polyolefin Resin Fine Particle Dispersion Having Polar Group (Polyolefin Resin Dispersion D))

The same procedures as in the polymerization process of the polyolefin resin fine particle dispersion A except that the ratio of ethylene and vinyl acetate is changed from 20/80 to 10/90 to obtain an ethylene-vinyl acetate resin emulsion D having a glass transition point of 22° C., a median diameter of 0.45 μm and a solid content of 56.1%.

(Preparation of Resin Fine Particle Dispersion (1))

| | |
|---|---|
| Styrene | 480 parts by weight |
| n-Butyl acrylate | 120 parts by weight |
| Acrylic acid | 12 parts by weight |
| Dodecanethiol | 12 parts by weight |

The foregoing components are mixed and dissolved to prepare a solution.

Separately, 12 parts by weight of an anionic surfactant (Dowfax, produced by Rhodia, Inc.) is dissolved in 250 parts by weight of ion exchanged water, and the foregoing solution is added thereto, followed by dispersion and emulsification in a flask (Monomer Emulsion A).

1 part by weight of an anionic surfactant (Dowfax, produced by Rhodia, Inc.) is dissolved in 555 parts by weight of ion exchanged water, and the solution is charged in a polymerization flask. The polymerization flask is sealed, and a reflux tube is equipped therewith. Under injection of nitrogen, the polymerization flask is heated to 75° C. on a water bath under slowly stirring, and that condition is maintained. 9 parts by weight of ammonium persulfate is dissolved in 43 parts by weight of ion exchanged water, and the resulting solution is added dropwise into the polymerization flask through a metering pump over 20 minutes. The monomer emulsion A is then added dropwise through a metering pump over 200 minutes.

Thereafter, the polymerization flask is maintained at 75° C. for 3 hours under slowly stirring to complete polymerization.

Consequently, an anionic resin fine particle dispersion (1) containing fine particles having a median diameter of 230 nm, a glass transition point of 52.5° C. and a weight average molecular weight of 22,000, and having a solid content of 42% is obtained.

(Preparation of Resin Fine Particle Dispersion (2))

The same procedures as in the preparation of the resin fine particle dispersion (1) are carried out except that the amount of acrylic acid is changed to 9 parts by weight, and the amount of the dodecanethiol is changed to 15 parts by weight to obtain an anionic resin fine particle dispersion (2) containing fine particles having a median diameter of 200 nm, a glass transition point of 50.5° C. and a weight average molecular weight of 18,000, and having a solid content of 42%.

(Preparation of Colorant Particle Dispersion (1))

| | |
|---|---|
| C.I. Pigment Yellow (PY74, produced by Clariant Japan, Co., Ltd.) | 50 parts by weight |
| Anionic surfactant (Neogen R, produced by | 5 parts by weight |

-continued

| | |
|---|---|
| Daiichi Kogyo Seiyaku Co., Ltd.) | |
| Ion exchanged water | 200 parts by weight |

The foregoing components are mixed and dissolved, and they are dispersed in a homogenizer (Ultra Turrax T50, produced by IKA Works Inc.) for 10 minutes to obtain a yellow colorant particle dispersion (1) having a median diameter of 200 nm and a solid content of 21.5%.

(Preparation of Colorant Particle Dispersion (2))

The same procedures as in the preparation of the colorant particle dispersion (1) are carried out except that a cyan pigment (C.I. Pigment Blue 15:3, copper phthalocyanine, produced by Dainichiseika Color and Chemicals Mfg. Co., Ltd.) is used instead of the yellow pigment to obtain a cyan colorant particle dispersion (2) having a median diameter of 190 nm and a solid content of 21.5%.

(Preparation of Colorant Particle Dispersion (3))

The same procedures as in the preparation of the colorant particle dispersion (1) are carried out except that a magenta pigment (PR122, produced by Dainippon Ink And Chemicals, Inc.) is used instead of the yellow pigment to obtain a colorant particle dispersion (3) having a median diameter of 160 nm and a solid content of 21.5%.

(Preparation of Colorant Particle Dispersion (4))

The same procedures as in the preparation of the colorant particle dispersion (1) are carried out except that a black pigment (carbon black, produced by Cabot, Inc.) is used instead of the yellow pigment to obtain a colorant particle dispersion (4) having a median diameter of 170 nm and a solid content of 21.5%.

(Preparation of Releasing Agent Particle Dispersion)

| | |
|---|---|
| Polywax 725 (melting point: 100° C.) (produced by Toyo Petrolight Co., Ltd.) | 50 parts by weight |
| Anionic surfactant (Dowfax, produced by Rhodia, Inc.) | 5 parts by weight |
| Ion exchanged water | 200 parts by weight |

The foregoing components are heated to 110° C. and sufficiently dispersed in a homogenizer (Ultra Turrax T50, produced by IKA Works Inc.), and then they are subjected to a dispersion treatment with a pressure discharge disperser (Gaulin Homogenizer) to obtain a releasing agent particle dispersion having a median diameter of 150 nm and a solid content of 21.0%.

Example 1

(Preparation of Toner Particles)

| | |
|---|---|
| Polyolefin resin dispersion A corresponding to 10 parts by weight of resin | 19 parts by weight |
| Resin fine particle dispersion (1) corresponding to 74 parts by weight of resin | 200 parts by weight |
| Colorant particle dispersion (1) corresponding to 8.6 parts by weight of pigment | 40 parts by weight |
| Releasing agent particle dispersion corresponding to 8.6 parts by weight of releasing agent | 40 parts by weight |
| Polyaluminum chloride | 0.15 part by weight |

The foregoing components are sufficiently mixed and dispersed in a round bottom stainless steel flask with a homogenizer (Ultra Turrax T50, produced by IKA Works Inc.), and then heated to 48° C. on a heating oil bath under stirring the contents of the flask. After maintaining at 48° C. for 60 minutes, 68 parts by weight of the resin fine particle dispersion (1) (corresponding to 28.6 parts by weight of resin) is added thereto, followed by gradually stirring.

Thereafter, the pH of the system is adjusted to 6.0 with a sodium hydroxide aqueous solution, and then the system is heated to 95° C. under continuous stirring.

During the temperature increasing and maintaining operation, the pH of the system is prevented from decreasing to 5.5 or lower by adding dropwise a sodium hydroxide aqueous solution.

After completing the reaction, the contents of the flask are cooled, filtered and sufficiently washed with ion exchanged water, followed by subjecting to solid-liquid separation by Nutsche suction filtration. The resulting product is again dispersed in 3 L of ion exchanged water at 40° C. and then washed by stirring at 300 rpm for 15 minutes. The washing operation is repeated 5 times, and then the product is subjected to solid-liquid separation by Nutsche suction filtration, followed by subjecting vacuum drying for 12 hours, to obtain toner particles.

The measurement of the toner particles with a Coulter counter shows a volume average particle size $D_{50}$ of 5.8 $\mu$m, a volume average particle size distribution index GSDv of 1.21 and a surface property index of 1.65. The shape factor SF1 of the toner particles obtained by shape observation with a Luzex image analyzer is 130, which indicates a potato-like shape.

1.2 parts by weight of hydrophobic silica (TS720, produced by Cabot, Inc.) is added to 50 parts by weight of the toner particles, and they are mixed in a sample mill to obtain an external addition toner.

A ferrite carrier having an average particle diameter of 50 $\mu$m having 1% of polymethyl methacrylate (produced by Soken Chemical & Engineering Co., Ltd.) coated thereon is used, and the external addition toner is weighed to make a toner concentration of 5%. The carrier and the toner are stirred and mixed in a ball mill for 5 minutes to prepare a developer.

(Evaluation of Toner)

The image quality and the fixing property are evaluated by using the foregoing developer with a modified machine with intermediate transfer belt of DocuColor1250 and with a modified machine with toner reclaiming process of DocuCenter450 produced by Fuji Xerox Co., Ltd. The image quality is good for both solid image uniformity and thin line reproducibility in both machines. The fixing property of the toner is evaluated by using J-coat paper produced by Fuji Xerox Co., Ltd. as transfer paper and adjusting the process speed to 180 mm/sec. The oilless fixing property using a PFA tube fixing roll is good, and it is confirmed that the image exhibits sufficient fixing property at 135° C. or more, and the transfer paper is released without any resistance. The surface glossiness of an image at a fixing temperature of 180° C. is as good as 65% with good developing property and transfer property, and the image exhibits high chroma saturation.

(Folding Strength)

The folding strength is evaluated in the following manner. A sample fixed at 180° C. on J-coat paper produced by Fuji Xerox Co., Ltd. is folded at an acute angle on a solid table by using a metallic ruler and then opened. The cracked part of the image is rubbed with a cloth, and the presence of formation of image defects is evaluated. While cracks are found on close-up observation, substantially no image defect is observed, and thus the sample is accepted.

(Offset Temperature)

No occurrence of hot offset is observed at a fixing temperature of 220° C.

(OHP Transparency)

The fixing property of the toner is evaluated by using an OHP sheet (for monochrome, produced by Fuji Xerox Co., Ltd.). The transparency of the image on the OHP sheet is good, and a transparent image without turbidity is confirmed.

(Lowest Fixing Temperature)

The lowest fixing temperature is evaluated by contamination of an image upon rubbing the image with a cloth.

(Image Quality)

The image quality is evaluated by observing an image fixed on transfer paper with the naked eye for uniformity of a solid image, reproducibility of thin lines and contamination of background part. It is evaluated by chroma saturation of a solid image part for a color image.

Example 2

Toner particles are obtained in the same manner as in Example 1 except that in Example 1, the polyolefin resin dispersion A is changed to 45.5 parts by weight (corresponding to 10 parts by weight of resin) of the polyolefin resin dispersion B, the resin fine particle dispersion (1) is changed to the resin fine particle dispersion (2), the colorant particle dispersion (1) is changed to the colorant particle dispersion (2), and the pH upon heating to 95° C. is changed to 4.5 maintained.

The toner has a volume average particle size $D_{50}$ of 5.50 μm, a volume average particle size distribution index GSDv of 1.19 and the surface property index of 1.44. The shape factor SF1 of the toner particles is 123, which indicates a substantially spherical shape.

An external addition toner is obtained by using the toner particles, and a developer is obtained, in the same manner as in Example 1. The fixing property of the toner is evaluated in the same manner as in Example 1. The oilless fixing property using a PFA tube fixing roll is good, and it is confirmed that the image exhibits sufficient fixing property at 130° C. or more, and the transfer paper is released without any resistance.

Based on the foregoing evaluation of the toner, the surface glossiness of an image at a fixing temperature of 180° C. is as good as 76% with good developing property and transfer property, and the image exhibits high chroma saturation. The image quality is good for both uniformity of a solid image and reproducibility of thin lines.

In the evaluation of folding strength, substantially no image defect is observed, and thus the sample is accepted while cracks are found on close-up observation.

No occurrence of hot offset is observed at a fixing temperature of 220° C.

The fixing property of the toner is evaluated by using an OHP sheet (for monochrome, produced by Fuji Xerox Co., Ltd.). The transparency of the image on the OHP sheet is good, and a transparent image without turbidity is confirmed.

Example 3

Toner particles are obtained in the same manner as in Example 1 except that in Example 2, the resin fine particle dispersion (1) is changed to the resin fine particle dispersion (2), the colorant particle dispersion (2) is changed to the colorant particle dispersion (3), and the pH upon heating to 95° C. is changed to 3.5 maintained.

The toner has a volume average particle size $D_{50}$ of 5.40 μm, a volume average particle size distribution index GSDv of 1.22 and the surface property index of 1.22. The shape factor SF1 of the toner particles is 112, which indicates a spherical shape.

An external addition toner is obtained by using the toner particles, and a developer is obtained, in the same manner as in Example 1. The fixing property of the toner is evaluated in the same manner as in Example 1. The oilless fixing property using a PFA tube fixing roll is good, and it is confirmed that the image exhibits sufficient fixing property at 130° C. or more, and the transfer paper is released without any resistance.

The surface glossiness of an image at a fixing temperature of 180° C. is as good as 85% with good developing property and transfer property, and the image exhibits high chroma saturation. The image quality is good for both uniformity of a solid image and reproducibility of thin lines.

In particular, the transfer efficiency is substantially 100%.

No occurrence of hot offset is observed at a fixing temperature of 210° C. and is slightly observed at 220° C., but it causes no problem upon practical use.

In the evaluation of folding strength, substantially no image defect is observed, and thus the sample is accepted while cracks are found on close-up observation.

The fixing property of the toner is evaluated by using an OHP sheet (for monochrome, produced by Fuji Xerox Co., Ltd.). The transparency of the image on the OHP sheet is good, and a transparent image without turbidity is confirmed.

Example 4

Toner particles are obtained in the same manner as in Example 1 except that in Example 1, the amount of the polyolefin resin dispersion A to be added is reduced by half, the amount of polyaluminum chloride is changed to 0.20 part by weight, and the pH upon heating to 95° C. is changed to 6.5 maintained.

The toner has a volume average particle size $D_{50}$ of 5.90 μm, a volume average particle size distribution index GSDv of 1.22 and the surface property index of 1.93. The shape factor SF1 of the toner particles is 138, which indicates a potato-like shape.

An external addition toner is obtained by using the toner particles, and a developer is obtained, in the same manner as in Example 1. The fixing property of the toner is evaluated in the same manner as in Example 1. The oilless fixing property using a PFA tube fixing roll is good, and it is confirmed that the image exhibits sufficient fixing property at 135° C. or more, and the transfer paper is released without any resistance.

The surface glossiness of an image at a fixing temperature of 180° C. is as good as 48%, which is slightly low, with good developing property and transfer property, and the image exhibits high chroma saturation.

In the evaluation of folding strength, substantially no image defect is observed, and thus the sample is accepted while cracks are found on close-up observation, and some deterioration is found in comparison to Example 1.

No occurrence of hot offset is observed at a fixing temperature of 220° C.

The fixing property of the toner is evaluated by using an OHP sheet (for monochrome, produced by Fuji Xerox Co., Ltd.). The transparency of the image on the OHP sheet is good, and a transparent image without turbidity is confirmed.

Comparative Example 1

Toner particles are obtained in the same manner as in Example 2 except that in Example 2, the polyolefin resin dispersion B is changed to the polyolefin resin dispersion C.

The toner has a volume average particle size $D_{50}$ of 5.45 μm, a large volume average particle size distribution index GSDv of 1.31 and the surface property index of 1.15. The shape factor SF1 of the toner particles is 115, which indicates a spherical shape.

An external addition toner is obtained by using the toner particles, and a developer is obtained, in the same manner as in Example 1. The fixing property of the toner is evaluated in the same manner as in Example 1. The oilless fixing property using a PFA tube fixing roll is good, and it is confirmed that the image exhibits sufficient fixing property at 130° C. or more. However, the releasing condition of the transfer paper is poor, and flix and winding of the paper after fixing are observed. Furthermore, occurrence of hot offset is observed from a fixing temperature of 180° C., and thus glossiness cannot be evaluated.

In the evaluation of folding strength, large cracks are formed, and image defects are observed.

The OHP transparency is somewhat poor.

Comparative Example 2

Toner particles are obtained in the same manner as in Example 1 except that in Example 1, the polyolefin resin dispersion A is changed to the polyolefin resin dispersion D, and the pH upon heating to 95° C. is changed to 6.5 maintained.

The toner has a volume average particle size $D_{50}$ of 5.60 μm, a volume average particle size distribution index GSDv of 1.26 and the surface property index of 1.20. The shape factor SF1 of the toner particles is 142, which indicates a rough potato-like shape.

An external addition toner is obtained by using the toner particles, and a developer is obtained, in the same manner as in Example 1. The fixing property of the toner is evaluated in the same manner as in Example 1. The oilless fixing property using a PFA tube fixing roll is not good, and no sufficient fixing property is obtained until 170° C. The releasing property is good, but the glossiness of the image at a fixing temperature of 180° C. is as low as 20%, and the chroma saturation is also low.

In the evaluation of folding strength, large cracks are formed, and image defects are observed.

No occurrence of hot offset is observed at a fixing temperature of 220° C.

The image is somewhat poor in developing property and transfer property, and the sharpness of the image is somewhat short.

The fixing property of the toner is evaluated by using an OHP sheet (for monochrome, produced by Fuji Xerox Co., Ltd.). A transmission image with considerable turbidity is confirmed in the image on the OHP sheet.

The evaluation results are summarized in Table 1 below.

TABLE 1

| | Example | | | | Comparative Example | |
|---|---|---|---|---|---|---|
| | 1 | 2 | 3 | 4 | 1 | 2 |
| Polyolefin resin dispersion | (A) 19 | (B) 45.5 | (B) 45.5 | (A) 9.5 | (C) 45.5 | (D) 19 |
| Weight average molecular weight of polyolefin resin | 450,000 | 15,000 | 15,000 | 450,000 | 15,000 | 450,000 |
| Glass transition point of polyolefin resin | 0° C. | ≦° C. | ≦0° C. | 0° C. | ≦0° C. | 22° C. |
| Median diameter of polyolefin resin dispersion (μm) | 0.45 | 0.25 | 0.25 | 0.45 | 0.25 | 0.75 |
| Kind and amount of resin dispersion (part by weight) | (1) 268 | (2) 268 | (2) 268 | (1) 268 | (2) 268 | (1) 268 |
| Kind and amount of colorant dispersion (part by weight) | (1) 40 | (2) 40 | (3) 40 | (1) 40 | (2) 40 | (1) 40 |
| Kind and amount of releasing agent dispersion (part by weight) | (1) 40 | (1) 40 | (1) 40 | (1) 40 | (1) 40 | (1) 40 |
| Volume average particle size of toner (μm) | 5.80 | 5.50 | 5.40 | 5.90 | 5.45 | 5.60 |
| GSDv | 1.12 | 1.19 | 1.22 | 1.22 | 1.31 | 1.26 |
| Shape factor (SF1) | 130 | 123 | 112 | 138 | 115 | 142 |
| Surface property index | 1.65 | 1.44 | 1.22 | 1.93 | 1.15 | 2.20 |
| Folding strength | good | good | good | good | poor | poor |
| Image quality in 2 machines | good | good | good | good | poor | slightly poor |
| Lowest fixing temperature (° C.) | 135 | 130 | 130 | 135 | 130 | 140 |
| Hot offset temperature (° C.) | >220 | >220 | 220 | >220 | >220 | >220 |
| Glossiness at 180° C. (%) | 65 | 76 | 85 | 48 | cannot be evaluated | 20 |
| OHP transparency | good | good | good | good | poor | poor |

The invention can provide, by employing the foregoing constitution, such an image that is excellent in fixing characteristics, such as adhesion property of a fixed image to a fixing sheet, releasing property of a fixed sheet, hot offset resistance, folding resistance of a fixed image, surface glossiness of a fixed image and transparency of an OHP sheet, is good in developing property and transfer property, and is excellent in image quality.

The entire disclosure of Japanese Patent Application No. 2002-142150 filed on May 16, 2002 including specification, claims and abstract is incorporated herein by reference in its entirety.

What is claimed is:

1. A toner for developing an electrostatic image, comprising a colorant, a binder resin and a polyolefin resin, the polyolefin resin having a polar group and having a glass transition point of 20° C. or less and a weight average molecular weight of 10,000 or more.

2. The toner for developing an electrostatic image as claimed in claim 1, wherein the polyolefin resin is a copolymer.

3. The toner for developing an electrostatic image as claimed in claim 2, wherein the polyolefin resin has a copolymenzation ratio of a monomer having a polar group to a polyolefin monomer of from 5/95 to 50/50.

4. The toner for developing an electrostatic image as claimed in claim 1, wherein toner particles of the toner have a shape factor (SF1) of from 100 to 140.

5. The toner for developing an electrostatic image as claimed in claim 1, wherein the toner has a volume particle size distribution index GSDv of 1.30 or less.

6. The toner for developing an electrostatic image as claimed in claim 1, wherein the toner has a surface property index, which is defined by the following equation, of 2.0 or less in a state where no external additive is added:

$$\text{(surface property index)}=\text{(measured value of specific surface area)}/\text{(calculated value of specific surface area)}\ \text{(calculated value of specific surface area)}=6\Sigma(n\times R^2)/(\rho\times\Sigma(n\times R^3))$$

wherein n represents the number of particles in a channel of a Coulter counter, R represents the channel particle diameter of the Coulter counter, and ρ represents the density of the toner, with a number of channels of 16 and a size of division of 0.1 interval in log scale.

7. The toner for developing an electrostatic image as claimed in claim 1, wherein a content of the polyolefin resin is in a range of from 0.5 to 30%.

8. The toner for developing an electrostatic image as claimed in claim 1, wherein the polyolefin resin is an ethylene-vinyl acetate copolymer or an ethylene-acrylic acid copolymer.

9. The toner for developing an electrostatic image as claimed in claim 1, wherein toner particles of the toner are produced by a process comprising the steps of:

aggregating particles in a dispersion containing the particles dispersed therein, the particles containing resin particles containing the polyolefin resin; and coalescing the aggregated particles by heating.

10. The toner for developing an electrostatic image as claimed in claim 1, wherein toner particles of the toner is produced by a process comprising the steps of:

aggregating resin particles and releasing agent particles to generate aggregated particles, the resin particles containing fine particles having a median particle diameter of 1 μm or less comprising a polyolefin resin having a polar group, a glass transition point of 20° C. or less and a weight average molecular weight of 10,000 or more; covering the aggregated particles with a resin to form capsulated aggregated particles, the resin being different from the polyolefin resin and the releasing agent; and coalescing the capsulated aggregated particles by heating.

11. A developer for developing an electrostatic image, comprising a toner and a carrier, wherein the toner is the toner for deycloping an electrostatic image as claimed in claim 1.

12. The developer for developing an electrostatic image as claimed in claim 11, wherein, the carrier has a resin coating layer.

13. A process for producing an image comprising the steps of: forming an electrostatic latent image on an electrostatic latent image holding member; developing the electrostatic latent image with a developer; transferring a toner image thus formed to a transfer body; and fixing the toner image on the transfer body, the toner for forming the toner image comprising a polyolefin resin, a colorant, and a binder resin, the polyolefin resin having a polar group, a glass transition point of 20° C. or less and a weight average molecular weight of 10,000 or more.

14. The process for producing an image as claimed in claim 13, further comprising: recovering the toner left untransferred from the electrostatic latent image holding member and putting the recovered toner in a developing device after the transferring step.

15. The process for producing an image as claimed in claim 13, wherein the transferring step uses an intermediate transfer material.

16. The toner for developing an electrostatic image as claimed in claim 1, wherein the polyolefm resin is different from the binder resin.

* * * * *